US005099812A

United States Patent [19]

Yamada

[11] Patent Number: 5,099,812

[45] Date of Patent: Mar. 31, 1992

[54] CYLINDER HEAD FOR INTERNAL COMBUSTION ENGINE

[75] Inventor: Tetsuro Yamada, Iwata, Japan

[73] Assignee: Yamaha Hatsudoki Kabushiki Kaisha, Iwata, Japan

[21] Appl. No.: 578,933

[22] Filed: Sep. 7, 1990

[30] Foreign Application Priority Data

Mar. 10, 1989 [JP] Japan ..... 1-59461

[51] Int. Cl.[5] ..... F02B 75/02

[52] U.S. Cl. ..... 123/432; 123/315; 123/90.22; 123/90.28

[58] Field of Search ..... 123/432, 308, 315, 90.22, 123/90.23, 90.28

[56] References Cited

U.S. PATENT DOCUMENTS 4,007,716 2/1977 Jones ..... 123/90.28
4,549,510 10/1985 Miyakoshi et al. ..... 123/432
4,651,696 3/1987 Yoshikawa et al. ..... 123/432
4,660,529 4/1987 Yoshikawa ..... 123/432
4,805,567 2/1989 Heinburg ..... 123/90.28
4,809,663 3/1989 De Tomaso ..... 123/432
4,932,377 6/1990 Lyle ..... 123/432
4,971,008 11/1990 Morishita ..... 123/432

*Primary Examiner*—David A. Okonsky
*Attorney, Agent, or Firm*—Ernest A. Beutler

[57] ABSTRACT

A cylinder head construction for a multiple valve engine that permits the use of at least three intake valves while permitting a single piece head construction and offering ease of access of the hold down fasteners for the cylinder head. The intake tappets are all slidably supported within a projection of the cylinder head with the outer tappets being positioned closer to a plane containing the cylinder bore axis so that fastener receiving bores can be formed outwardly from this point without interference from the projection.

12 Claims, 9 Drawing Sheets

CYLINDER HEAD FOR INTERNAL COMBUSTION ENGINE

BACKGROUND OF THE INVENTION

This invention relates to a cylinder head for an internal combustion engine and more particularly to an improved cylinder head for a multi valve internal combustion engine.

The trend in modern engines and particularly high performance automotive engines is toward multiple valves that are operated by overhead mounted camshafts. Although four valve twin overhead camshaft engines are quite common, there is a desire for further increase of performance and efficiency through the use of a greater number of valves. Although five valve engines have been proposed, the addition of a third intake valve, as is typical with five valve practice, presents a number of problems.

One of the problems in conjunction with the provision of five intake valves for a single cylinder of an internal combustion engine is that if the valves are directly actuated through thimble tappets, then the cylinder head fasteners tend to interfere with the tappet guides, particularly on the intake side of the engine. To overcome these difficulties and to facilitate cylinder head attachment to the cylinder block, it has been the practice to employ a multi part cylinder head assembly, including a main cylinder head and a cam carrier that is affixed to the cylinder head and which forms the tappet guides. Although this type of arrangement is highly satisfactory, it has been the practice to mount the cylinder head attachment bolts under the cam carrier and hence the cam carrier must be removed in order to service the cylinder head bolt. In addition, the use of two separate castings gives rise to certain other problems which should be self evident.

It is, therefore, a principal object of this invention to provide an improved cylinder head assembly for an internal combustion engine.

It is a further object of this invention to provide an improved cylinder head assembly for a multi valve engine wherein there are a plurality of valves actuated by thimble tappets and yet a single cylinder head assembly may be employed without resorting to two piece construction.

It is a further object of this invention to provide a tappet arrangement for the cylinder head of an internal combustion engine that permits a one piece cylinder head assembly and adequate and accessible fasteners for affixing the cylinder head to an associated cylinder block.

SUMMARY OF THE INVENTION

This invention is adapted to be embodied in a cylinder head for an internal combustion engine that is comprised of at least three valves positioned substantially on one side of a longitudinal plane containing the axis of the associated cylinder bore. At least three tappet receiving bores are formed in an upwardly extending projection formed in the upper surface of the cylinder head for slidably supporting the tappets for actuation of respective valves. The center of the outer two of the tappet receiving bores are spaced closer to the longitudinal plane than the remaining of the tappet receiving bores. A pair of fastener receiving bores are formed in the cylinder head on opposite sides of the upwardly extending projection and the center of these fastener receiving bores lie further from the longitudinal plane than the centers of the outer two tappet receiving bores.

DETAILED DESCRIPTION OF THE PREFERRED EMBODIMENTS OF THE INVENTION

Figure 1:
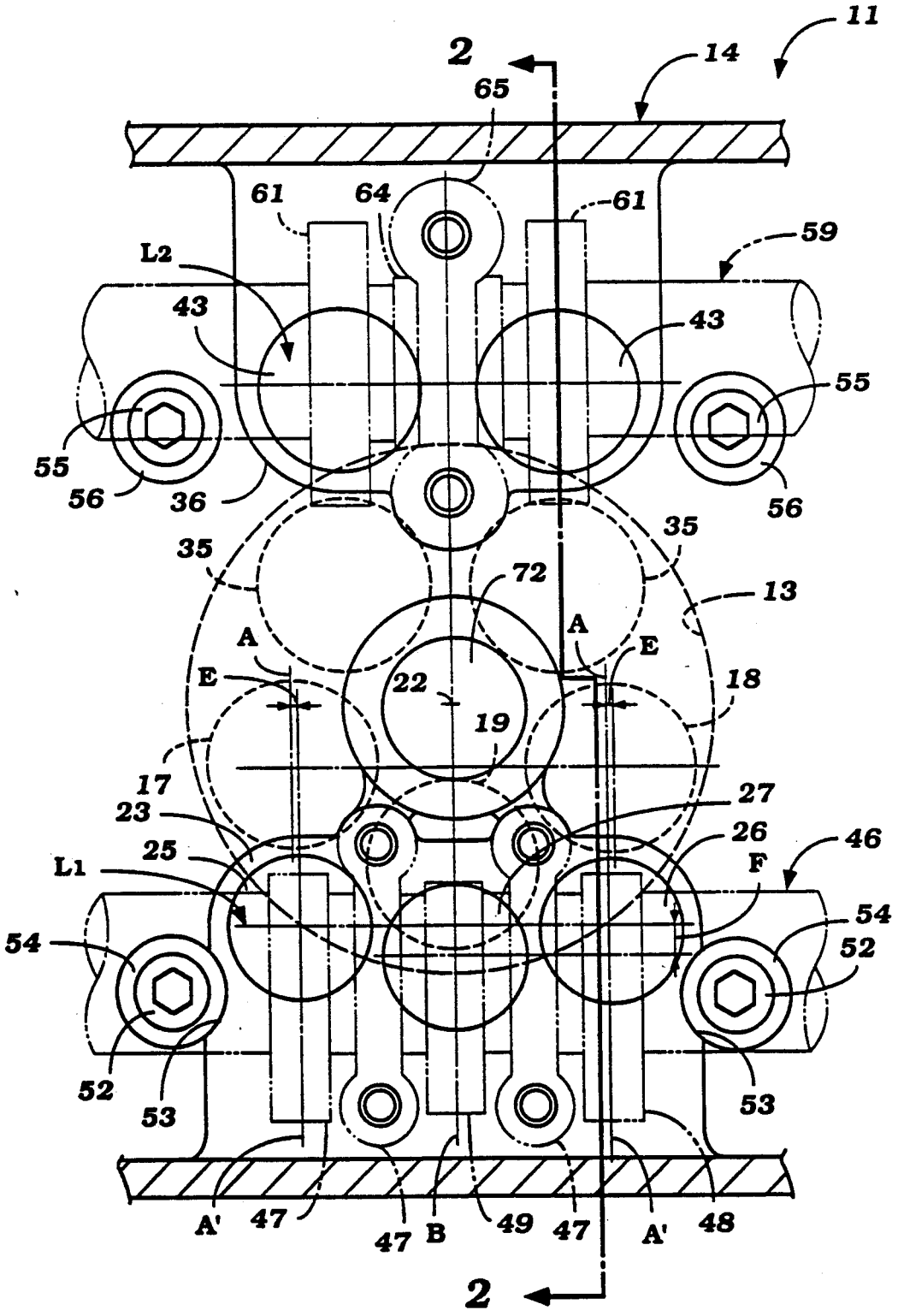
FIG. 1 is a top plan view of the cylinder head of an internal combustion engine constructed in accordance with an embodiment of the invention.
Figure 2:
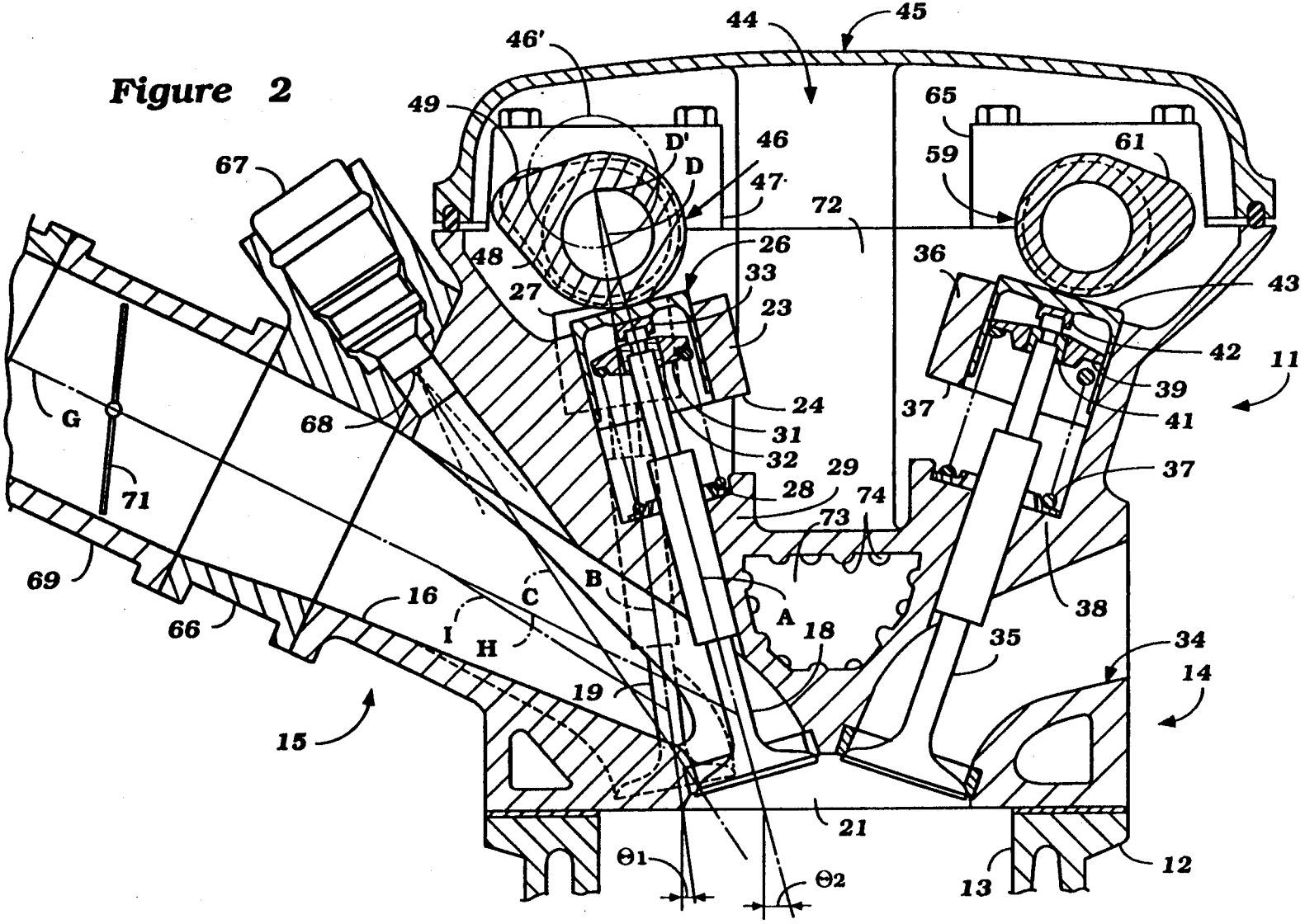
FIG. 2 is a cross sectional view taken along the line 2—2 of Figure and shows the upper portion of the cylinder head assembly and its relationship with the cylinder block.

Referring in detail to the drawings, initially to the embodiment of FIGS. 1 through 6 and specifically FIGS. 1 and 2, an internal combustion engine constructed in accordance with an embodiment of the invention is identified generally by the reference numeral 11. The engine 11 is, in the illustrated embodiment, of the multi cylinder in line type. It should be readily apparent to those skilled in the art, however, that the invention can be practiced in conjunction with single cylinder engines or multiple cylinder engines having other than in line configurations.

The engine 11 includes a cylinder block 12 in which a plurality of aligned cylinder bores 13 are formed. Pistons reciprocate in the cylinder bores 13 and are connected to a crankshaft for driving that crankshaft (not shown).

A cylinder head constructed in accordance with an embodiment of the invention and identified generally by the reference numeral 14 is affixed to the cylinder block 12 in a manner to be described. The cylinder head 14 is provided with an intake side, indicated by the reference numeral 15 and through which a siamese type intake passage 16 extends which terminates in three individual valve seats that are formed by pressed in valve seats.

A pair of side intake valves 17 and 18 and a center intake valve 19 cooperate with the valve seats to control the flow of intake charge from the intake passage 16 into a combustion chamber defined by a recess 21 formed in the lower surface of the cylinder head 14 and facing the cylinder bore 13. The intake valves 17 and 18 reciprocate about respective axes A that lie in a common plane and which is disposed at an acute angle θ2 to a plane containing the axis of the cylinder bore 13, indicated by the point 22 in FIG. 1. The intake valve 19 also reciprocates about an axis disposed at an acute angle to this plane (B). The angle of the axis of the intake valve 19 is, however, disposed at a smaller acute angle θ1 to this plane. This orientation is described in more detail in U.S. Pat. No. 4,660,529 entitled "Four Cycle Engine", issued Apr. 28, 1987 in the name of Masaaki Yoshikawa and assigned to the Assignee hereof. Because of that, further discussion of the specific orientation is not believed to be necessary.

The portion of the cylinder head on the intake side 15 where the intake valves 17, 18 and 19 are supported is formed with an upstanding projection 23 that is formed with a recessed opening 24 extending through one side thereof. The stems of the intake valves 17, 18 and 19 extend upwardly through this opening 24 and are activated at their upper ends by respective slidably supported thimble tappets 25, 26, and 27. The thimble tappets 25, 26 and 27 are slidably supported in bores formed in this projection as clearly shown in FIGS. 1 and 2. The axes of these bores coincide with the axes of reciprocation A and B of the valves 17 and 18 and 19.

Coil compression springs 28 encircle the stems of each of the valves 17, 18 and 19 and bear against retainer surfaces 29 machined into the upper surface of the cylinder head at the base of the tappet receiving bore. The other ends of the coil springs 28 act against a spring retainer 31 that is held to the upper end of the respective valve stem by a keeper 32 in a known manner. An adjusting shim 33 is positioned between the upper ends of the stems of the valves and the underside of the thimble tappets 25, 26 and 27 for clearance adjusting purposes.

The side of the cylinder head 11 opposite to the intake side 15 comprises the exhaust side and a pair of exhaust passages 34 extend from respective valve seats through this side of the cylinder head. The exhaust passages 34 may be separate or siamese. Exhaust valves 35 are slidably supported in the cylinder head and control the flow through these exhaust passages 34. There are two exhaust valves 35 and these exhaust valves reciprocate about axes that lie at a common plane and which are disposed at an acute angle to the plane containing the cylinder bore axis 22 as aforedescribed. The acute angle of this common plane is greater than the acute angle 81 and less than the acute angle θ2 as described in the aforenoted patent.

The exhaust valves 35 are supported within an upstanding projection 36 formed on the exhaust side of the engine. This projection 36 also is formed with a relief 37 like the upstanding projection 23 associated with the intake valve.

Coil compression springs 37 encircle the stems of the exhaust valves 35 and act against retainer bases machined in an area 38 at the base of the projection 36. The upper ends of the coil springs 37 act against spring retainers 39 which are held to the valve stems by keepers 41. Adjusting shims 42 are interposed between the ends of these stems and thimble tappets 43 that are slidably supported in bores formed in the projection 36 which bores have a common axis with the axis of reciprocation of the exhaust valves 35.

The valve mechanism as thus far described is contained within a cam chamber 44 formed by the upper inner surface of the cylinder head 14 and a cam cover 45 that is affixed to the cylinder head in a suitable manner. Contained within this cam chamber 44 is an intake camshaft 46 that is rotatably journaled by plane bearing surfaces formed in the cylinder head 14 and bearing surfaces formed by a bearing cap 50 that is affixed to the cylinder head in a suitable manner. This bolting arrangement may be best seen in FIG. 1. It should be noted that the bearing caps 50 are depicted as a unitary assembly and these span the center tappet 27. Of course, separate individual bearing caps may be employed if desired.

Figure 3:
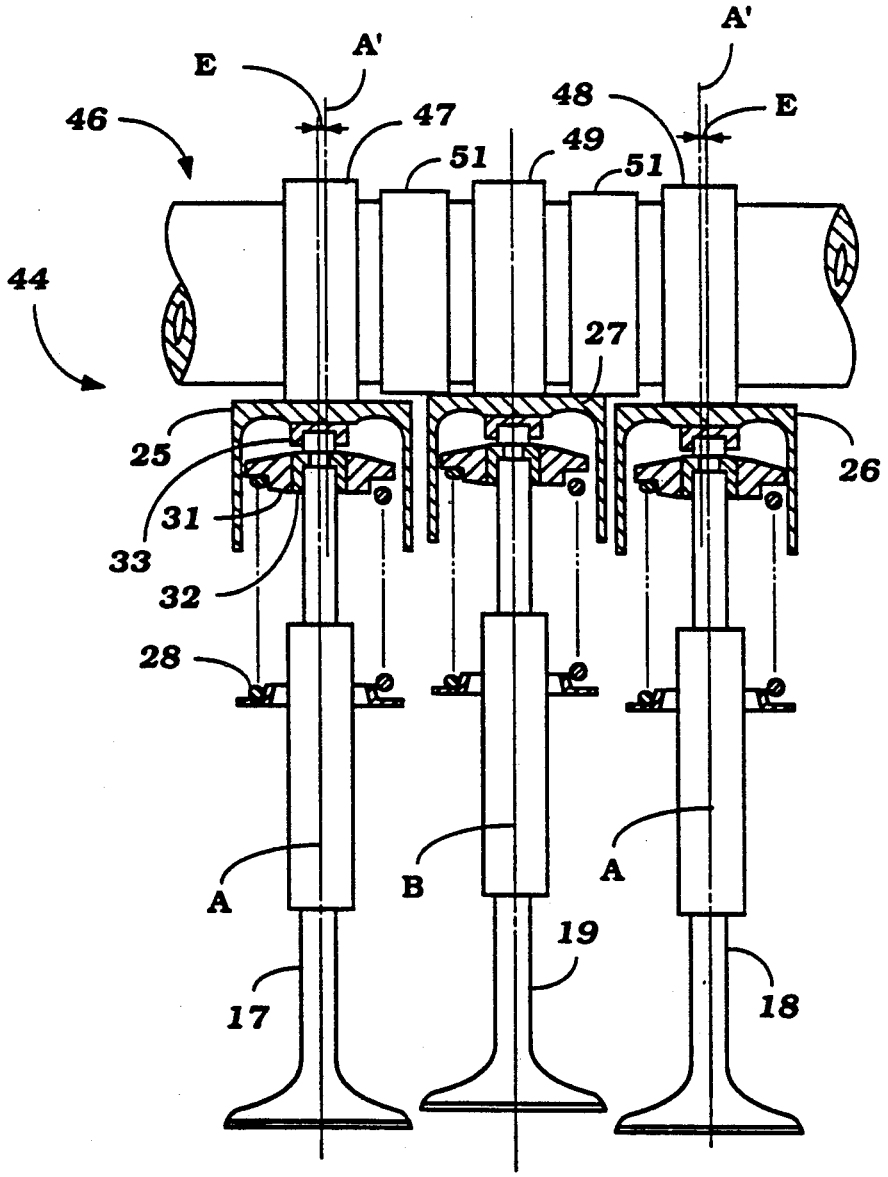
FIG. 3 is a side elevational view showing the relationship of the camshaft to the intake valves with the actuating tappets shown in cross section.

As may be best seen in FIG. 3, the camshaft 46 is provided with three cam lobes 47, 48 and 49 that cooperate with the individual thimble tappets 25, 26 and 27 for opening the valves 17, 18 and 19 in a known manner against the action of the springs 28. Bearing surfaces 51 are formed between these cam lobes for rotatably journaling the camshaft 46. The camshaft 46 is driven at one half engine speed through a suitable driving mechanism (not shown).

Figure 4:
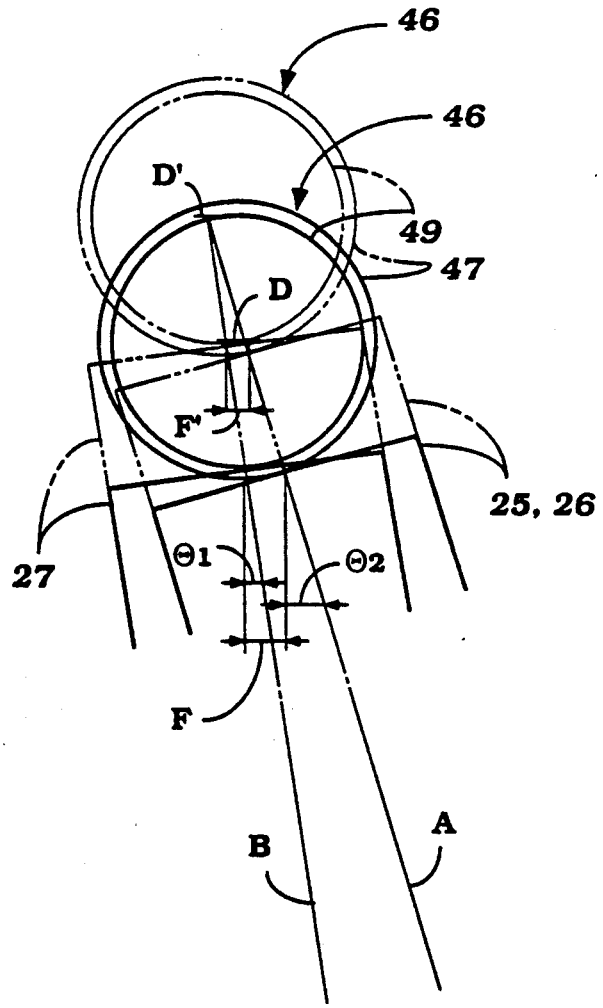
FIG. 4 is an end view showing the relationship of the intake camshaft to the tappets in accordance with the invention and in accordance with a prior art type of construction.
Figure 5:
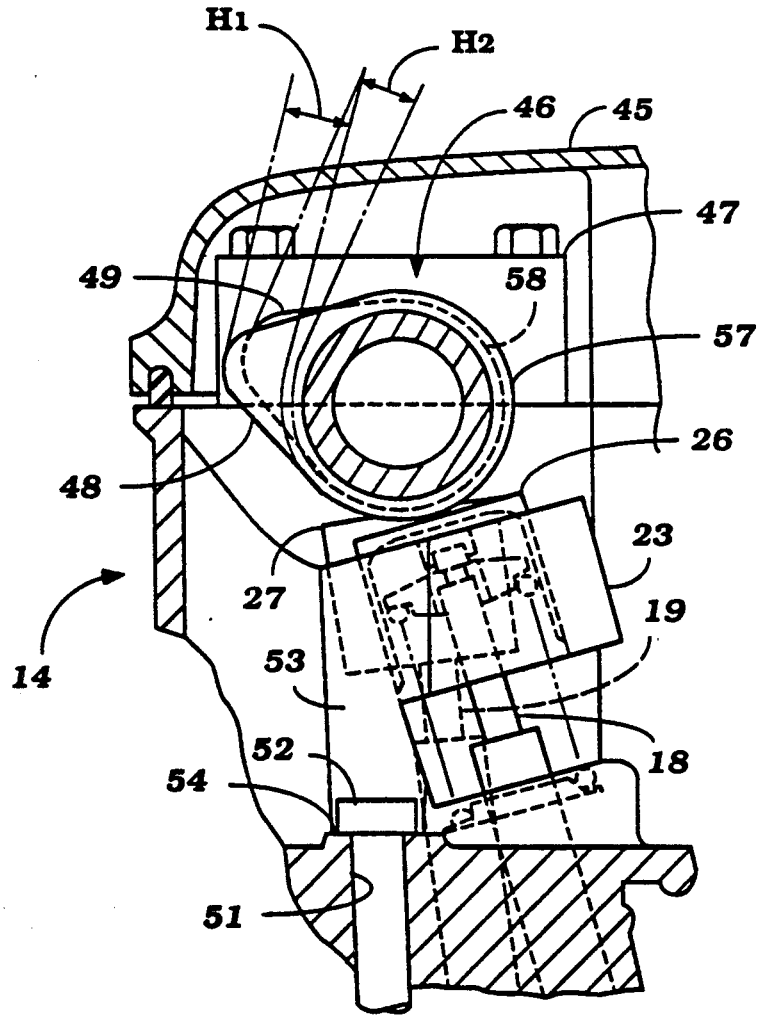
FIG. 5 is a further side elevational view, in part similar to FIG. 4, showing the actual tappet configuration and cam lobe arrangement associated with the intake camshaft and the intake valves.

It should be noted from FIGS. 2 and 4 that the rotational axis D of the intake camshaft 46 is disposed closer to the cylinder head than the point of intersection of the axes A and B, this point being indicated by the letter D'. This permits the camshaft 46 to be rotatably journaled about a lower point and permits a more compact cylinder head assembly as should be readily apparent from FIG. 4. As the camshaft axis is lowered, the distance of contact between the heels of the cam lobes 47, 48 and 49 (F) becomes greater than the corresponding distance F'. This is due to the angle of inclination of the respective valves. However, this permits the side tappets 25 and 26 to be moved closer to the plane containing the cylinder bore axis 25 as shown by the line L1 in FIG. 1.

Because of this relationship, it is possible to form openings 51 in the cylinder head 14 on opposite sides of the projection 23 without being obstructed by this projection. Threaded fasteners 52 such as socket headed screws are received within these bores 51 for affixing the cylinder head 14 to the cylinder block 12. The projections 23 are formed with reliefs 53 so as to pass tools for securing the fasteners 52 and also so as to facilitate machining of seating surfaces 54 for the fasteners 52. As a result of this construction, it is possible to form the cylinder head as a single piece and still offer an optimum bolt pattern.

The opposite side or exhaust side of the cylinder head is also formed with corresponding bores that receive threaded fasteners 55 which are disposed transversely outwardly from the exhaust tappet projection 36 and which bear against seating surfaces 56. It should be noted that the center of the bores that receive the fasteners 51 and 55 are equidistant from the center plane containing the axis 22 but that the bores for receiving the fasteners 52 are disposed transversely outwardly from the tappets 25 and 26, as aforenoted.

The fasteners 55 and specifically the bores that receive them are disposed closer to this plane than the plane containing the axes of reciprocation of the tappets 43, as indicated by the line L2 in FIG. 1.

As may be seen in FIG. 3, the center of the cam lobes 47 and 48 indicated by the line A' is offset from the center of the axes A of the intake valves 17 and 18 at a small eccentricity indicated by the dimension E in FIG. 3. This further assists in maintaining the tappets 25 and 26 quite close to each other and achieves the bolt configuration and access as aforedescribed.

Because of the orientation of the intake valves 17, 18 and 19, it was previously necessary to provide a different length for the intake valve 19 than the intake valves 17 and 18. The intake valves 17 and 18 are generally longer than the center intake valve 19. However, by appropriately forming the heel diameter 57 of the cam lobes 47 and 48 larger than the heel diameter 58 of the cam lobe 49, it is possible to utilize common length valves. The lift H1 and H2 of the valves is maintained the same by changing the configuration of the lobes so that equal operation can be achieved.

An exhaust camshaft 59 is rotatably journaled on the exhaust side of the engine and has respective cam lobes 61 that cooperate with the thimble tappets 43 for operating the exhaust valves. A single bearing surface 64 is provided between the cam lobe 61 and a bearing cap 65 is affixed to the cylinder head 14 so as to journal the exhaust camshaft 59. The exhaust camshaft 59, like the intake shaft, is driven from the engine output shaft by a suitable valve driving mechanism.

Figure 6:
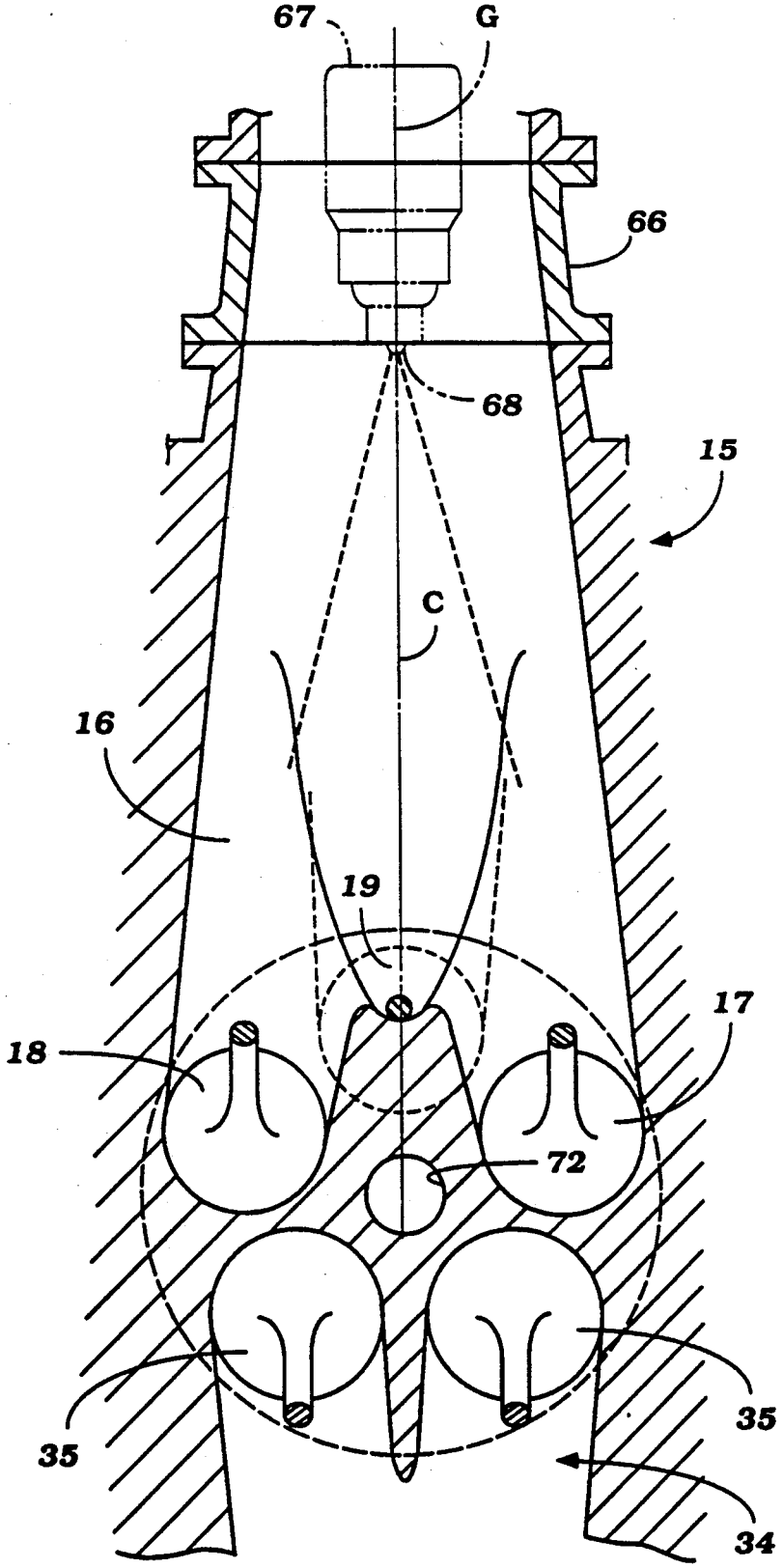
FIG. 6 is a cross sectional view taken through the intake and exhaust ports of the engine and showing the manner in which the fuel is injected.

An injection nozzle holder 66 is affixed to the intake side of the cylinder head 15 and mounts individual injection nozzles 67, one for each cylinder. The injection nozzles 67 are disposed as shown in FIG. 6 so as to have their spray nozzle parts 68 directed along an axis C which intersects the axis of reciprocation B of the center intake valve. This will assure the desired distribution of fuel in the combustion chamber.

A throttle body 69 is affixed to the nozzle holder 66 and contains a throttle valve 71 for controlling the running speed of the engine as is well known. A spark plug receiving bore 72 is formed centrally in the cylinder head 14 and supports a spark plug for firing of the charge in a known manner.

The cylinder head 14 is also provided with a cooling jacket 73 that extends primarily between the intake and exhaust valves and which is formed with dimple like projections 74 so as to increase the surface area so as to facilitate cooling.

It is to be understood that the engine as thus far described may be provided with an induction system and exhaust control valve system of the type described in my copending application entitled "Control Valve Arrangement For Engine", Ser. No. 580,117 filed Sept. 10, 1990 and assigned to the Assignee hereof, the disclosure of which is incorporated herein by reference. That type of induction and exhaust system has been found to improve the torque curve of the engine.

Figure 7:
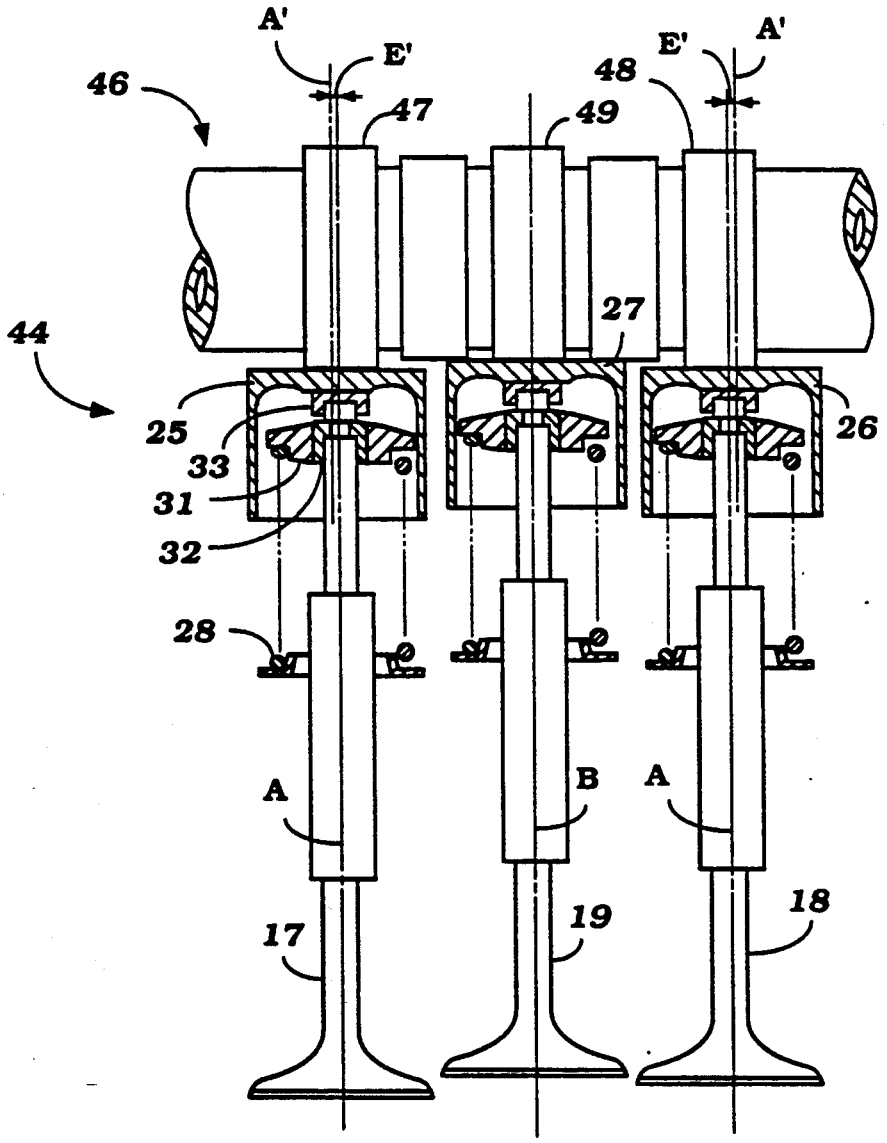
FIG. 7 is a view, in part similar to FIG. 3, showing another embodiment of the invention.
Figure 8:
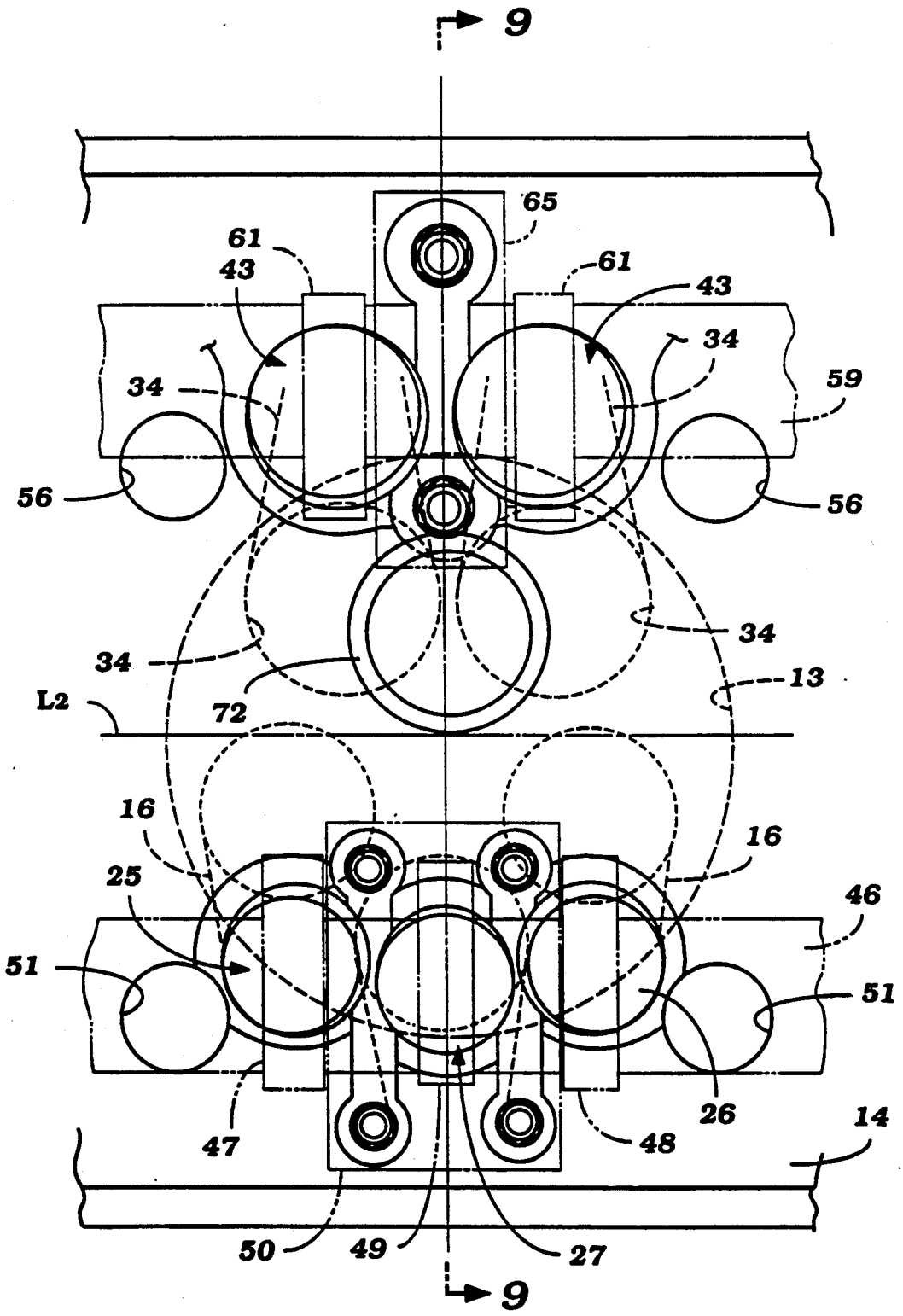
FIG. 8 is a top plan view of a cylinder head constructed in accordance with another embodiment of the invention.

In the embodiment of the invention as thus far described, the center of the cam lobes 47 and 48 were offset toward the cam lobe 49 from the center of the tappets 25 and 26. This permitted a more compact assembly. However, the opposite type of relationship is also possible and such an arrangement is shown in FIG. 7. In this embodiment, the center of the cam lobes 47 and 48 are disposed eccentrically outwardly from the center of the tappets 25 and 26 by a dimension E'. This permits the use of a wider bearing area for the bearings 51. In all other regards, this embodiment is the same as the previously described embodiment and, for that reason, further description of it is believed to be unnecessary.

Figure 9:
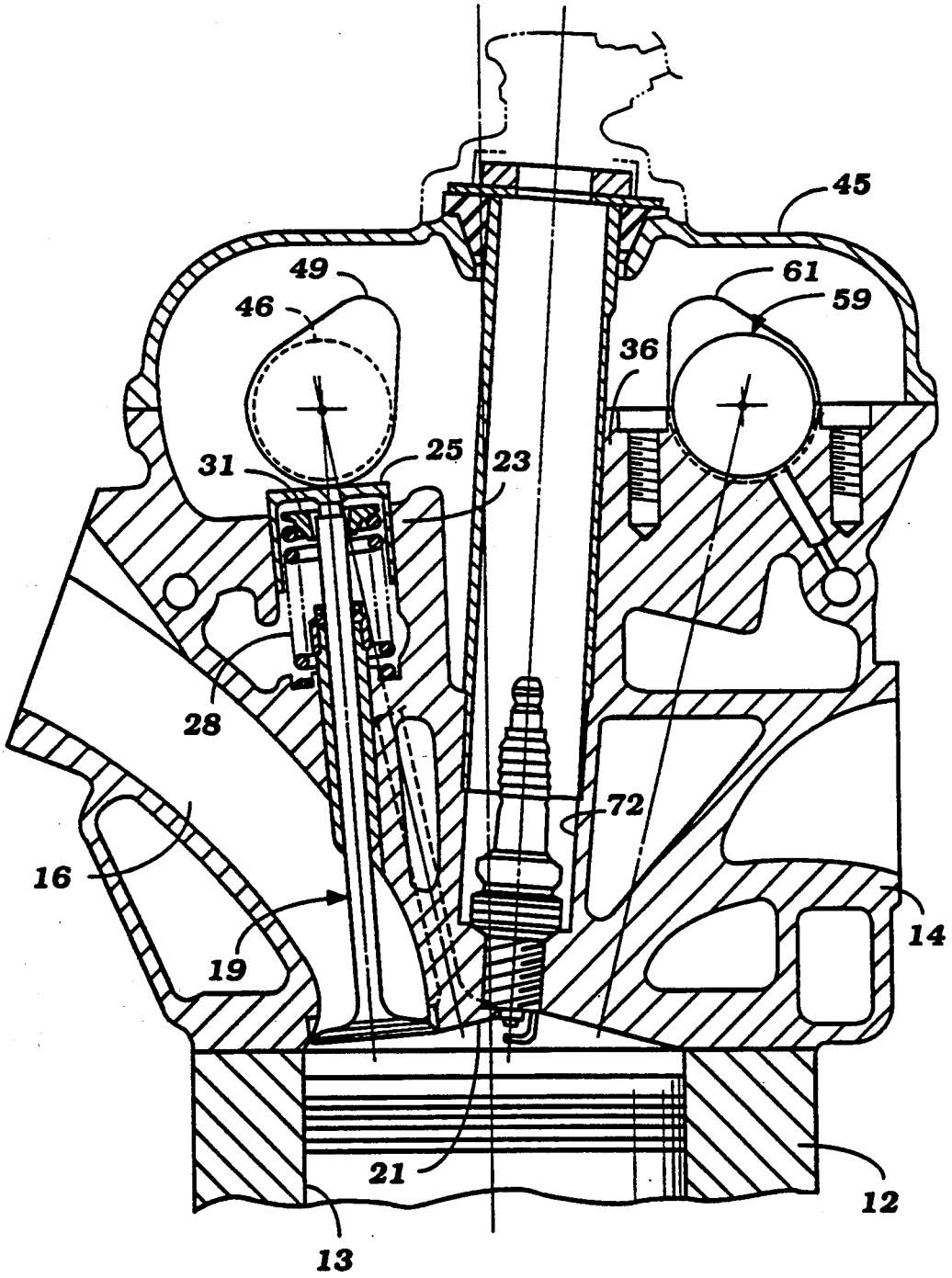
FIG. 9 is a cross sectional view taken along the line 9—9 of FIG. 8.

In the embodiments as thus far described, the spark plug well 72 and spark plug were disposed in a generally vertical direction so that the spark plug gap would lie on the cylinder bore axis 22. However, it is also possible to incline the spark plug well toward the exhaust side as shown in FIGS. 9 and 10 so as to provide an even more accessible cylinder head construction. In all other regards, this embodiment is the same as the previously described embodiments and, for that reason, further description of this embodiment is not believed to be necessary and the components of this embodiment which are the same or substantially the same as the previously described embodiments have been identified by the same reference numerals and further description is believed to be unnecessary.

It should be readily apparent from the foregoing description that the described engine constructions permit a very compact single piece cylinder head for use with multiple valve engines without adversely effecting the bolting arrangement and to assure simple and convenient bolt access. Although a number of embodiments of the invention have been illustrated and described, various changes and modifications may be made without departing from the spirit and scope of the invention, as defined by the appended claims.

I claim:

1. A cylinder head for an internal combustion engine comprising at least three valves substantially positioned on one side of a longitudinal plane containing the axis of the associated cylinder bore, at least three tappet receiving bores formed in an upwardly extending projection formed in the upper surface of said cylinder head for slidably supporting tappets for actuating respective of said valves, the centers of the outer two of said tappet receiving bores being spaced closer to said longitudinal plane than the remainder of said tappet receiving bores, and a pair of fastener receiving bores formed in said cylinder head on opposite sides of said upwardly extending projection, the center of said fastener receiving bores lying further from said longitudinal plane than the centers of said outer two tappet receiving bores.

2. A cylinder head as set forth in claim 1 further including tappets received in each of the tappet receiving bores and each directly actuated by a respective cam lobe of a single camshaft.

3. A cylinder head as set forth in claim 2 further including a bearing fixed to the cylinder head projection and rotatably journaling the camshaft.

4. A cylinder head as set forth in claim 3 wherein the cylinder head is formed with seating surfaces around the fastener receiving bores for engagement with fasteners, said projection extending above said seating surfaces.

5. A cylinder head as set forth in claim 4 further including at least two valves positioned on the other side of the longitudinal plane and at least two tappet receiving bores formed by a second upwardly extending projection formed on the upper surface of said cylinder head on the other side of said plane for supporting tappets for actuating said other pair of valves.

6. A cylinder head as set forth in claim 5 wherein the tappet receiving bores of the second projection are spaced further from the plane than the outer tappet receiving bores of the first projection.

7. A cylinder head as set forth in claim 6 wherein the other pair of tappet receiving bores receive tappets operated by the respective cams of a second camshaft.

8. A cylinder head as set forth in claim 7 further including a spark plug recess formed in the cylinder head and inclined toward the side containing the second projection.

9. A cylinder head as set forth in claim 4 wherein the axes of the tappet receiving bores intersect a line extending above the axis of rotation of the camshaft.

10. A cylinder head as set forth in claim 2 wherein the cylinder head is formed with seating surfaces around the fastener receiving bores for engagement with fasteners, said projection extending above said seating surfaces.

11. A cylinder head as set forth in claim 10 wherein the cam lobes associated with the outer pair of tappets have their centers disposed closer to each other than the centers of the tappets.

12. A cylinder head as set forth in claim 10 wherein the centers of the lobes associated with the outer of the tappets are disposed further away from each other than the centers of said outer tappets.

* * * * *